US010044112B2

(12) United States Patent
Park et al.

(10) Patent No.: US 10,044,112 B2
(45) Date of Patent: Aug. 7, 2018

(54) VARIABLE ANTENNA AND APPARATUS FOR DETECTING RADIO SIGNAL

(71) Applicant: ELECTRONICS AND TELECOMMUNICATIONS RESEARCH INSTITUTE, Daejeon (KR)

(72) Inventors: Gwang Moon Park, Daejeon (KR); Haeng Sook Ro, Daejeon (KR); Sang In Cho, Daejeon (KR); Yong Seok Choi, Daejeon (KR)

(73) Assignee: ELECTRONICS AND TELECOMMUNICATIONS RESEARCH INTITUTE, Daejeon (KR)

( * ) Notice: Subject to any disclaimer, the term of this patent is extended or adjusted under 35 U.S.C. 154(b) by 138 days.

(21) Appl. No.: 15/209,951

(22) Filed: Jul. 14, 2016

(65) Prior Publication Data

US 2017/0141482 A1 May 18, 2017

(30) Foreign Application Priority Data

Nov. 18, 2015 (KR) ..... 10-2015-0161910

(51) Int. Cl.

| | |
|---|---|
| ***H01Q 21/00*** | (2006.01) |
| ***H01Q 21/24*** | (2006.01) |
| ***H01Q 1/24*** | (2006.01) |
| ***H01Q 9/14*** | (2006.01) |
| ***H01Q 9/16*** | (2006.01) |
| ***H01Q 21/20*** | (2006.01) |
| ***H01Q 21/30*** | (2006.01) |

(52) U.S. Cl.
CPC ..... *H01Q 21/24* (2013.01); *H01Q 1/24* (2013.01); *H01Q 9/145* (2013.01); *H01Q 9/16* (2013.01); *H01Q 21/20* (2013.01); *H01Q 21/30* (2013.01)

(58) Field of Classification Search
CPC ..... H01Q 3/26; H01Q 21/08; H01Q 1/246; H01Q 5/00; H01Q 13/02
USPC ..... 343/853, 852, 761, 776, 879
See application file for complete search history.

(56) References Cited

U.S. PATENT DOCUMENTS

2010/0171663 A1* 7/2010 Fukada ..... G01S 3/74 342/394
2013/0207844 A1 8/2013 Lee et al.
(Continued)

FOREIGN PATENT DOCUMENTS

KR 10-0544677 1/2006

*Primary Examiner* — Dameon E Levi
*Assistant Examiner* — Collin Dawkins
(74) *Attorney, Agent, or Firm* — Kile Park Reed & Houtteman PLLC

(57) ABSTRACT

Disclosed are a variable antenna and an apparatus for detecting a radio signal. The variable antenna includes: a first receiving unit including at least one liquid metal antenna element; a second receiving unit including at least one liquid metal antenna element having a length different from a length of the first receiving unit; and a gain control unit configured to electrically adjust lengths of the liquid metal antenna elements for one of the first receiving unit and the second receiving unit according to the frequency of a received signal, wherein each antenna array realized by the liquid metal antenna elements of the first receiving unit and the second receiving unit is arranged in a single bay.

16 Claims, 10 Drawing Sheets

(56) References Cited

U.S. PATENT DOCUMENTS

| | | | | |
|---|---|---|---|---|
| 2014/0145899 | A1* | 5/2014 | Yang | H01Q 1/243<br>343/860 |
| 2014/0168022 | A1 | 6/2014 | Cetiner et al. | |
| 2015/0071310 | A1 | 3/2015 | Kim et al. | |

* cited by examiner

VARIABLE ANTENNA AND APPARATUS FOR DETECTING RADIO SIGNAL

CROSS-REFERENCE TO RELATED APPLICATION

This application claims the benefit of priority to Korean Patent Application No. 10-2015-0161910, filed on Nov. 18, 2015 in the Korean Intellectual Property Office, the disclosure of which is incorporated herein in its entirety by reference.

BACKGROUND OF THE INVENTION

Field of the Invention

The present disclosure relates to a variable antenna and an apparatus for detecting a radio signal.

Description of the Related Art

In a conventional radio monitoring and direction finding system, when array antenna having the same antenna element and radius is arranged in a single bay, a very high/ultra-high frequency (V/UHF) band cannot be covered due to a wave characteristic.

For example, when the antenna element is a dipole antenna, if the antenna element having a constant length exceeds a specific frequency, an antenna performance may be rapidly reduced. When the radius of array antenna is greater than a specific distance in a single bay, a signal may not be distinguished from a spurious signal, and the spurious signal is increased in a spatial spectrum so that the direction of the signal cannot be estimated. Further, if the distance between array antennas is not spaced apart by a specific distance or greater, interference is increased due to a mutual coupling between heterogeneous array antennas located in different bays so that the direction of received signal cannot be estimated.

Accordingly, the radio monitoring and direction finding system may spatially separate heterogeneous array antennas having a different element length and may arrange in a plurality of bays in order to cover a wide frequency range. However, an installation space over a certain size should be provided for the radio monitoring and direction finding system.

SUMMARY OF THE INVENTION

The present disclosure has been made in view of the above problems, and provides a variable antenna and an apparatus for detecting a radio signal capable of arranging heterogeneous antenna elements having a different radius of an array antenna in a single bay by using a variable liquid metal antenna so that it is possible to secure a compact and optional antenna gain.

In accordance with an aspect of the present disclosure, a variable antenna includes: a first receiving unit including at least one liquid metal antenna element; a second receiving unit including at least one liquid metal antenna element having a length different from a length of the first receiving unit; and a gain control unit configured to electrically adjust lengths of the liquid metal antenna elements for one of the first receiving unit and the second receiving unit according to the frequency of a received signal, wherein each antenna array realized by the liquid metal antenna elements of the first receiving unit and the second receiving unit is arranged in a single bay. The gain control unit adjusts a length of the liquid metal antenna element of the first receiving unit to a minimum length when receiving the signal with a high frequency, and adjusts a length of the liquid metal antenna element of the second receiving unit to a minimum length when receiving the signal with a low frequency. A maximum length of the liquid metal antenna element of the first receiving unit is greater than a maximum length of the liquid metal antenna element of the second receiving unit. The liquid metal antenna elements of the first receiving unit and the second receiving unit are vertically arranged in different locations of the same direction based on a center axis. The liquid metal antenna elements of the first receiving unit and the second receiving unit are vertically arranged in different directions based on a center axis. The liquid metal antenna elements of the first receiving unit and the second receiving unit are alternately arranged to have a certain angle. A radius of the antenna array of the first receiving unit is greater than a radius of the antenna array of the second receiving unit. The gain control unit variably controls at least one of shapes of the liquid metal antenna elements and a radius of the antenna array according to the frequency of a received signal.

In accordance with another aspect of the present disclosure, provided is an apparatus for detecting a radio signal configured to measure a signal by the variable antenna, and detect the direction of a signal by using a phase differences between antennas.

BRIEF DESCRIPTION OF THE DRAWINGS

The objects, features and advantages of the present disclosure will be more apparent from the following detailed description in conjunction with the accompanying drawings, in which.

DETAILED DESCRIPTION OF EXEMPLARY EMBODIMENTS

Exemplary embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

A variable antenna according to the present disclosure may be configured by various types of antennas such as a monopole antenna, a dipole antenna, a loop antenna, and a patch antenna. However, in an embodiment of the present disclosure, although a configuration and an operation are described based on the dipole antenna for the purpose of description, the present disclosure is not limited thereto.

Figure 1:
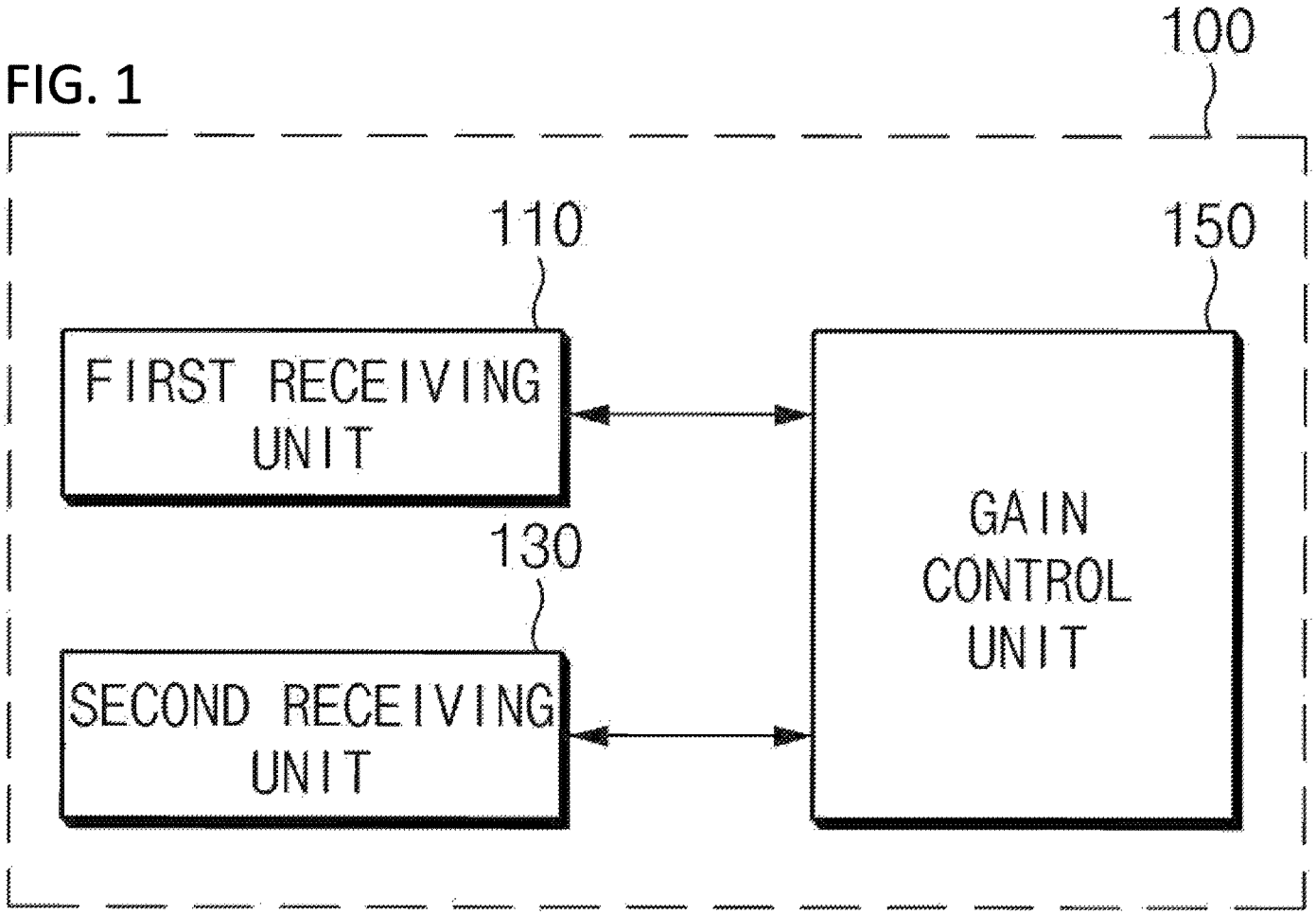
FIG. 1 is a block diagram illustrating a configuration of a variable antenna according to the present disclosure.

FIG. 1 is a block diagram illustrating a configuration of a variable antenna according to the present disclosure.

As shown in FIG. 1, the variable antenna 100 may include a first receiving unit 110, a second receiving unit 130, and a gain control unit 150.

First, the first receiving unit 110 may be configured by a liquid metal antenna element. In this case, a length of the liquid metal antenna element may be electrically adjusted by the gain control unit 150.

In addition, the first receiving unit 110 may receive the signal with a low frequency by using an array antenna having a radius larger than that of the second receiving unit 130. When the first receiving unit 110 receives the signal with a low frequency, the gain control unit 150 may minimize interference caused by the second receiving unit 130 by adjusting a length of an antenna element of the second receiving unit 130 to a minimum length. In this case, the gain control unit 150 may also adjust the length of the antenna element of the first receiving unit 110 within a certain range according to the frequency of a received signal. Meanwhile, while receiving the signal with a high frequency, the length of the antenna element of the first receiving unit 110 may be adjusted to the minimum length by the gain control unit 150.

In this case, a maximum length of the antenna element of the first receiving unit 110 may be greater than a maximum length of an antenna element of the second receiving unit 130.

Further, the first receiving unit 110 may include a plurality of antenna elements. A plurality of antenna elements included in the first receiving unit 110 may be located in the same distance in a horizontal direction based on a center axis, and may be spaced apart from each other by the same distance. As another example, antenna elements of the first receiving unit 110 may be equally and vertically arranged on a circumference having a certain radius, and may be vertically arranged to have a given pattern on a line having a given shape.

Similarly, the second receiving unit 130 may be configured by a liquid metal antenna element. In this case, the length of the liquid metal antenna element may be electrically adjusted by the gain control unit 150.

Further, the second receiving unit 130 may receive the signal with a high frequency by using an array antenna having a radius smaller than that of the first receiving unit 110. When the second receiving unit 130 receives the signal with a high frequency, the gain control unit 150 may minimize interference caused by the first receiving unit 110 by adjusting a length of the antenna element of the first receiving unit 110 to a minimum length. In this case, the gain control unit 150 may also adjust the length of the antenna element of the second receiving unit 130 within a certain range according to the frequency of a received signal. Meanwhile, while receiving the signal with a low frequency, the length of the antenna element of the second receiving unit 130 may be adjusted to a minimum length by the gain control unit 150.

In this case, a maximum length of the antenna element of the second receiving unit 130 may be shorter than a maximum length of the antenna element of the first receiving unit 110.

Further, the second receiving unit 130 may include a plurality of antenna elements. The plurality of antenna elements included in the second receiving unit 130 may be located in the same distance in a horizontal direction based on the center axis, and may be spaced apart from each other by the same distance. As another example, antenna elements of the second receiving unit 130 may be equally and vertically arranged on a circumference having a radius different from that of the antenna elements of the first receiving unit 110, and may be vertically arranged to have a given pattern on a line having a given shape.

In this case, the antenna elements of the second receiving unit 130 may be configured in a different location to have the same pattern as that of the antenna elements of the first receiving unit 110, and may be configured to have a different pattern.

In this case, the plurality of antenna elements included in the first receiving unit 110 and the plurality antenna elements included in the second receiving unit 130 may be horizontally arranged on a single bay.

In this case, the plurality of antenna elements included in the first receiving unit 110 and the plurality of antenna elements included in the second receiving unit 130 may be arranged in the same direction based on the center axis. In this case, the antenna elements of the first receiving unit 110 and the second receiving unit 130 may be arranged in different locations on a single antenna arm to be perpendicular to the antenna arm.

Meanwhile, the plurality of antenna elements included in the first receiving unit 110 and the plurality of antenna elements included in the second receiving unit 130 may be arranged in a different direction based on the center axis. In this case, the antenna elements of the first receiving unit 110 and the second receiving unit 130 may be arranged on an antenna arm implemented to a have different length in a different direction based on the center axis to be perpendicular to the antenna arm. In this case, the antenna elements of the first receiving unit 110 and the second receiving unit 130 may be alternately arranged.

In this case, the radio signals received by the antenna elements of the first receiving unit 110 and the antenna elements of the second receiving unit 130 may have a different phase.

The gain control unit 150 may adjust the length of the antenna element of the first receiving unit 110 and/or the second receiving unit 130 according to the frequency of a received signal. In other words, the gain control unit 150 may electrically adjust a liquid metal in the antenna element of the first receiving unit 110 and/or the second receiving unit 130.

As an example, the gain control unit 150 may electrically adjust the liquid metal in the antenna element of the second receiving unit 130 to minimize a length of a corresponding antenna element in order to receive the signal with a low frequency. In this case, the gain control unit 150 may electrically adjust the liquid metal in the antenna element of the first receiving unit 110 according to the frequency of a received signal so that the antenna element may have an optimal antenna gain.

As another example, the gain control unit 150 may electrically adjust the liquid metal in the antenna element of the first receiving unit 110 in order to receive the signal with a high frequency so that a corresponding antenna element may have a minimum length. In this case, the gain control unit 150 may electrically adjust the liquid metal in the antenna element of the second receiving unit 130 according to the frequency of a received signal so that the antenna element may have a given length.

In the embodiment of the present disclosure, it is illustrated that the length of the antenna element is adjusted according to the frequency of a received signal. However, the shape of the antenna element and the radius of the array antenna may be also changed depending on an embodiment.

Further, FIG. 1 shows that the variable antenna includes two receiving units, for example, the first receiving unit and the second receiving unit which have antenna elements having a different length. However, when another antenna array is configured by changing the length of the antenna element, the variable antenna may include three or more receiving units, for example, the first receiving unit, the second receiving unit, a third receiving unit, a fourth receiving unit, and the like.

Figure 2A:
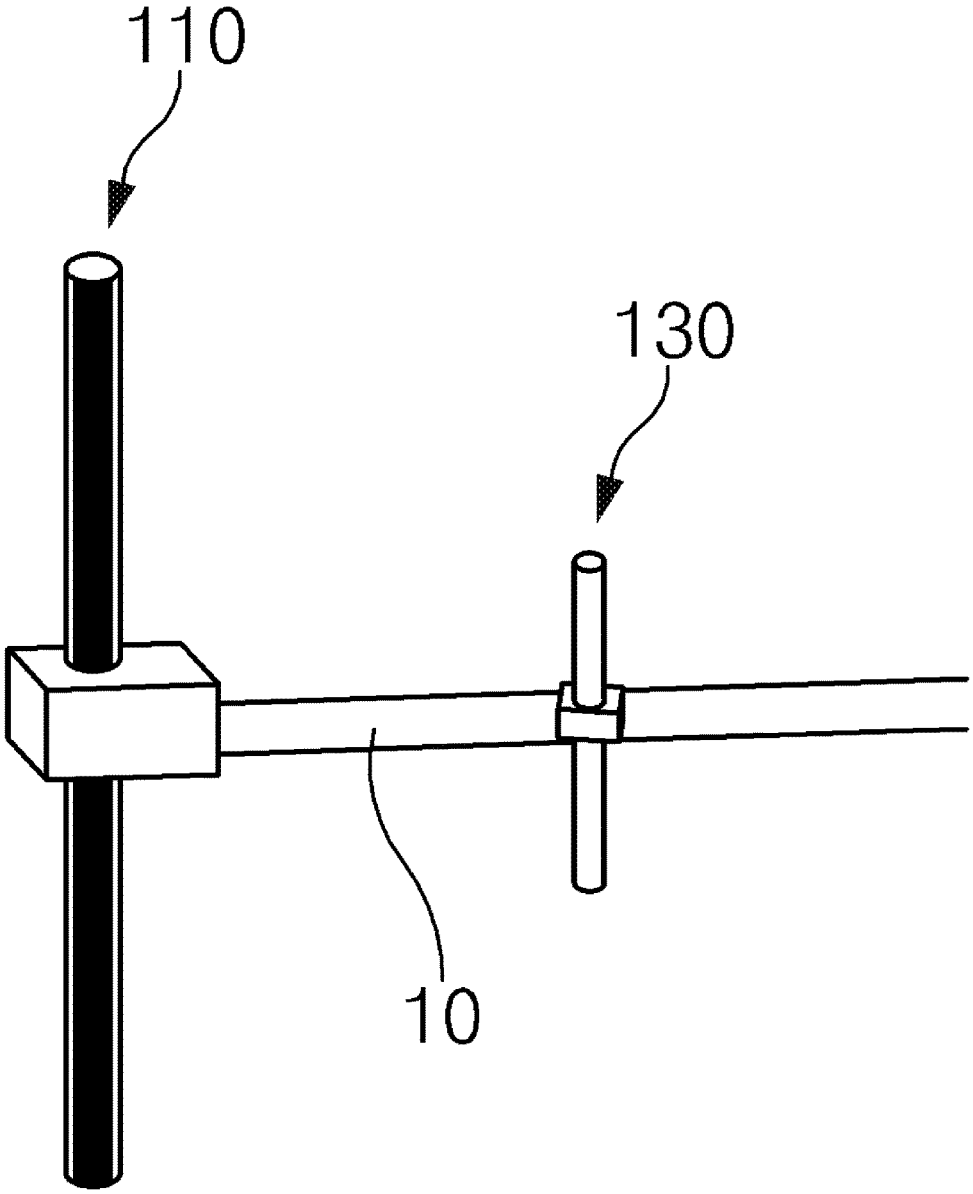
FIG. 2A and FIG. 2B are diagrams illustrating an embodiment for describing a variable control operation for an antenna element of a first receiving unit and a second receiving unit shown in FIG. 1.
Figure 2B:
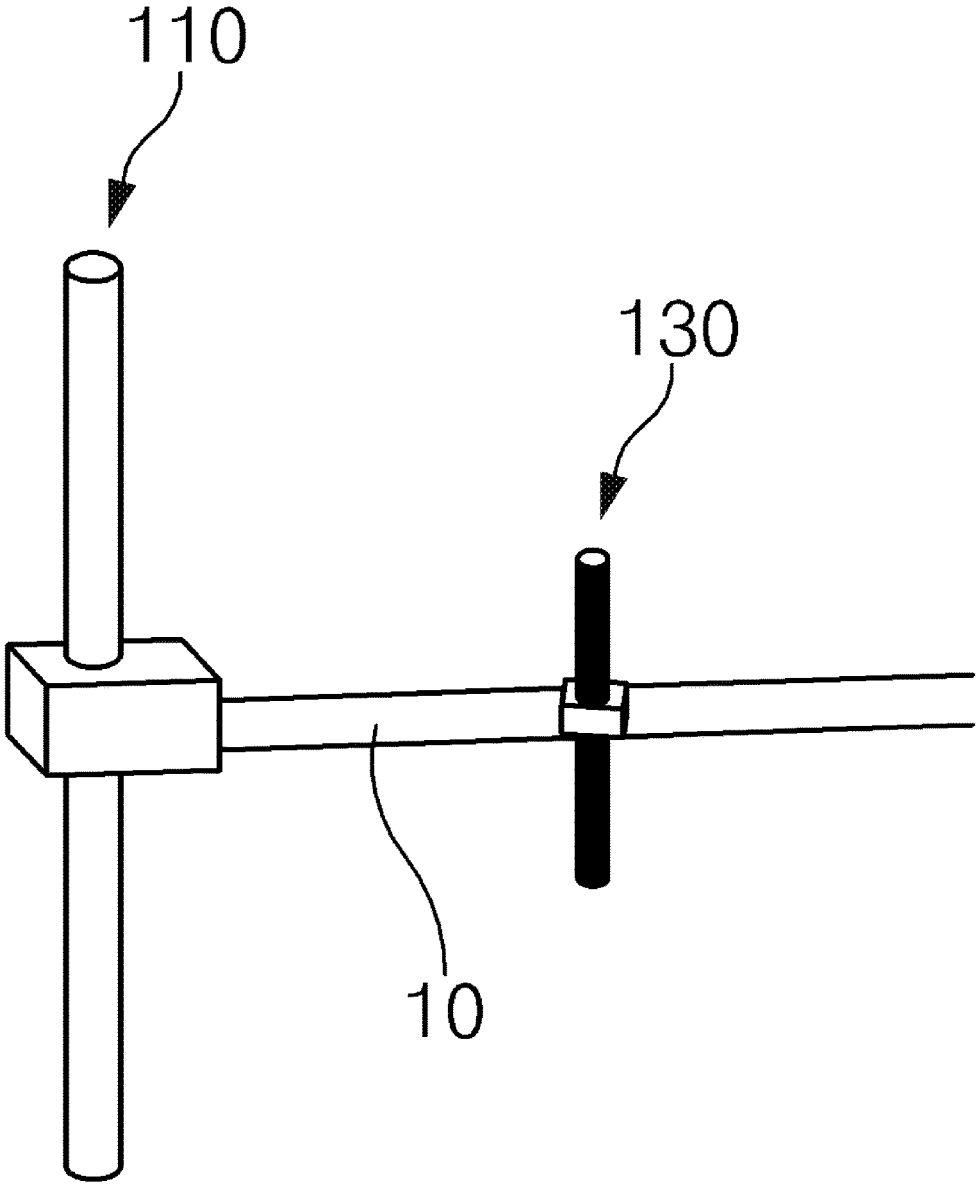

FIG. 2A and FIG. 2B are diagrams illustrating an embodiment for describing a variable control operation for an antenna element of the first receiving unit 110 and the second receiving unit 130 shown in FIG. 1.

First, FIG. 2A illustrates an operation for variably controlling an antenna element of the first receiving unit 110 and the second receiving unit 130 when receiving the signal with a low frequency.

In FIG. 2A, the antenna element of the first receiving unit 110 may be an antenna element for receiving the signal with a low frequency, and a maximum length of the antenna element of the first receiving unit 110 is greater than that of the antenna element of the second receiving unit 130.

When receiving the signal with a low frequency by the antenna element of the first receiving unit 110, interference may be caused from the antenna element of the second receiving unit 130.

Accordingly, the gain control unit 150 of the variable antenna according to the present disclosure may electrically adjust a liquid metal in the antenna element of the second receiving unit 130 so that a corresponding antenna element may have a minimum length. In this case, the variable antenna according to the present disclosure may minimize interference caused by the antenna element of the second receiving unit 130 while receiving the signal with the low frequency by the antenna element of the first receiving unit 110.

Meanwhile, FIG. 2B illustrates an operation of variably controlling the antenna element of the first receiving unit 110 and the second receiving unit 130 when receiving the signal with a high frequency.

In FIG. 2B, the antenna element of the second receiving unit 130 may be an antenna element for the signal with a high frequency, and may be implemented to have a maximum length shorter than that of the antenna element of the first receiving unit 110.

When receiving the signal with a high frequency by the antenna element of the second receiving unit 130, interference may be caused from the antenna element of the first receiving unit 110.

Accordingly, the gain control unit of the variable antenna according to the present disclosure may electrically adjust a liquid metal in the antenna element of the first receiving unit 110 so that a corresponding antenna element has a minimum length. In this case, the variable antenna according to the present disclosure may minimize the interference caused from the antenna element of the first receiving unit 110 while receiving the signal with a high frequency by the antenna element of the second receiving unit 130.

Figure 3:
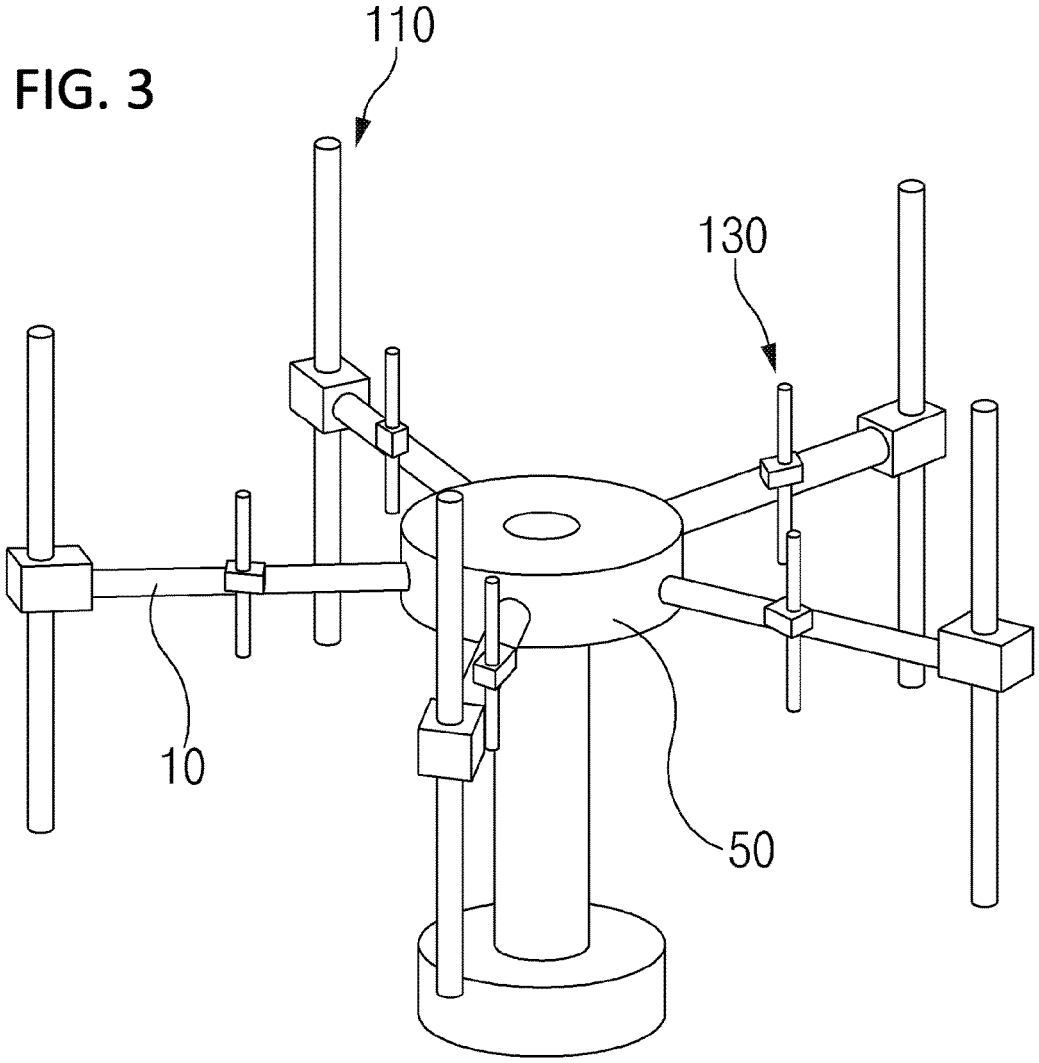
FIG. 3 is a diagram illustrating a variable antenna according to a first embodiment of the present disclosure.

FIG. 3 is a diagram illustrating a variable antenna according to a first embodiment of the present disclosure.

In the case of the variable antenna shown in FIG. 3, the antenna element of the first receiving unit 110 and the antenna element of the second receiving unit 130 may be arranged in a single bay on the same axis.

In FIG. 3, a mast 50 for supporting an antenna array may be fixed in a center axis. A plurality of antenna arms 10 having the same length may be fixed to the mast 50. In this case, one sides of the plurality of antenna arms 10 may be fixed to the mast 50 to be spaced apart each other. In this case, the antenna arm 10 may include a matching circuit such as a balun.

An embodiment shown in FIG. 3 illustrates a form where both of the antenna elements of the first receiving unit 110 and the second receiving unit 130 are arranged in a single antenna arm 10. In other words, the antenna element of the first receiving unit 110 may be vertically fixed to an end of the other side of the antenna arm 10. Meanwhile, the antenna element of the second receiving unit 130 may be vertically fixed to one point between the mast 50 and the antenna element of the first receiving unit 110 on the antenna arm 10.

In this case, the antenna element of the second receiving unit 130 for the signal with a high frequency may be implemented to have a maximum length shorter than that of the antenna element of the first receiving unit 110.

Since the variable antenna shown in FIG. 3 may electrically adjust the length of the antenna element by using a liquid metal, even if heterogeneous antenna elements having a different length are arranged in a single antenna arm 10, it is possible to minimize the interference between antennas.

Figure 4:
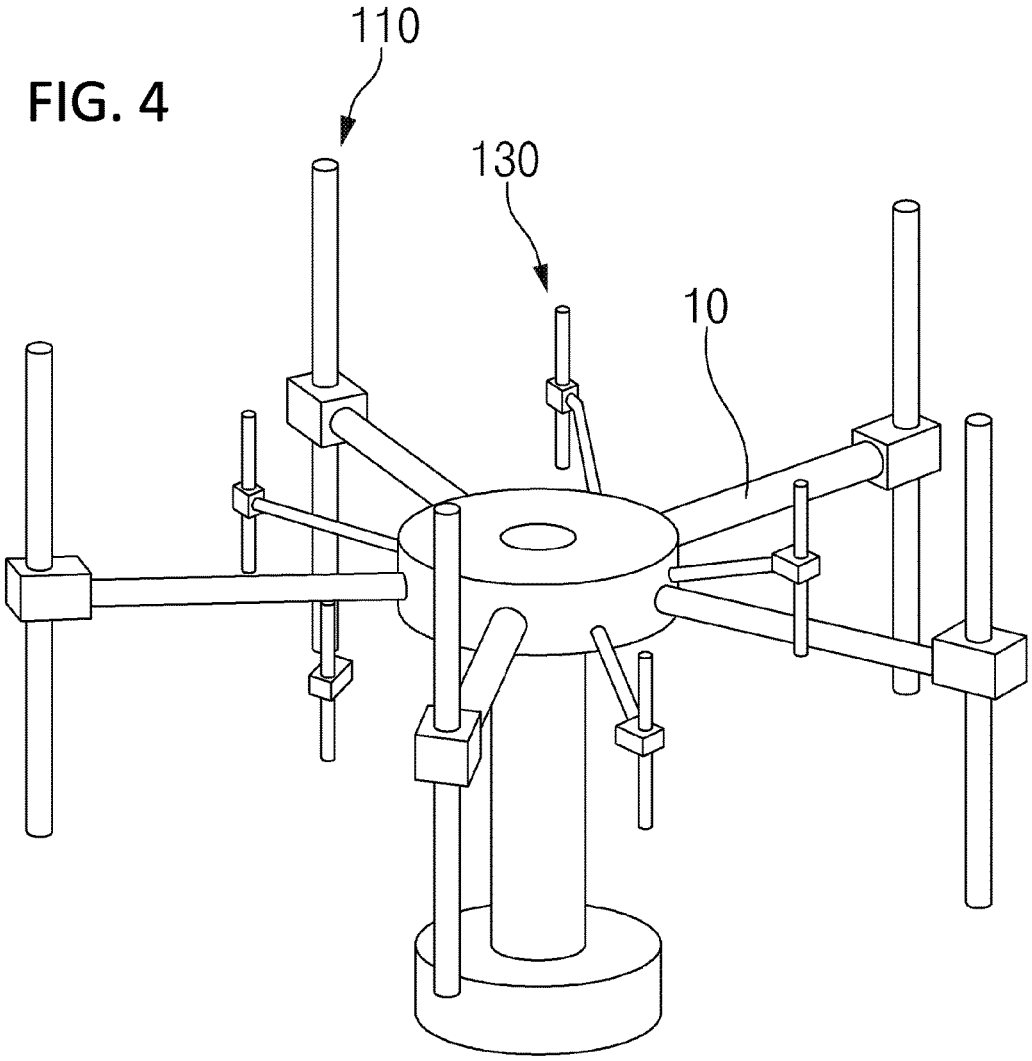
FIG. 4 is a diagram illustrating a variable antenna according to a second embodiment of the present disclosure.

FIG. 4 is a diagram illustrating a variable antenna according to a second embodiment of the present disclosure.

Although the shape of the variable antenna according to the embodiment of FIG. 4 is similar to the shape of the antenna shown in FIG. 3, the arranged location of the antenna element of the first receiving unit 110 is different from the arranged location of the antenna element of the second receiving unit 130.

According to the embodiment of FIG. 4, antenna arms 10 having two different lengths may be alternately fixed in the mast 50 to be spaced apart from each other by a certain distance. In this case, the antenna element of the first receiving unit 110 may be vertically fixed to the end of the other side of the antenna arm 10 having a long length. The antenna element of the second receiving unit 130 may be vertically fixed to the end of the other side of the antenna arm 10 having a short length.

Figure 5:
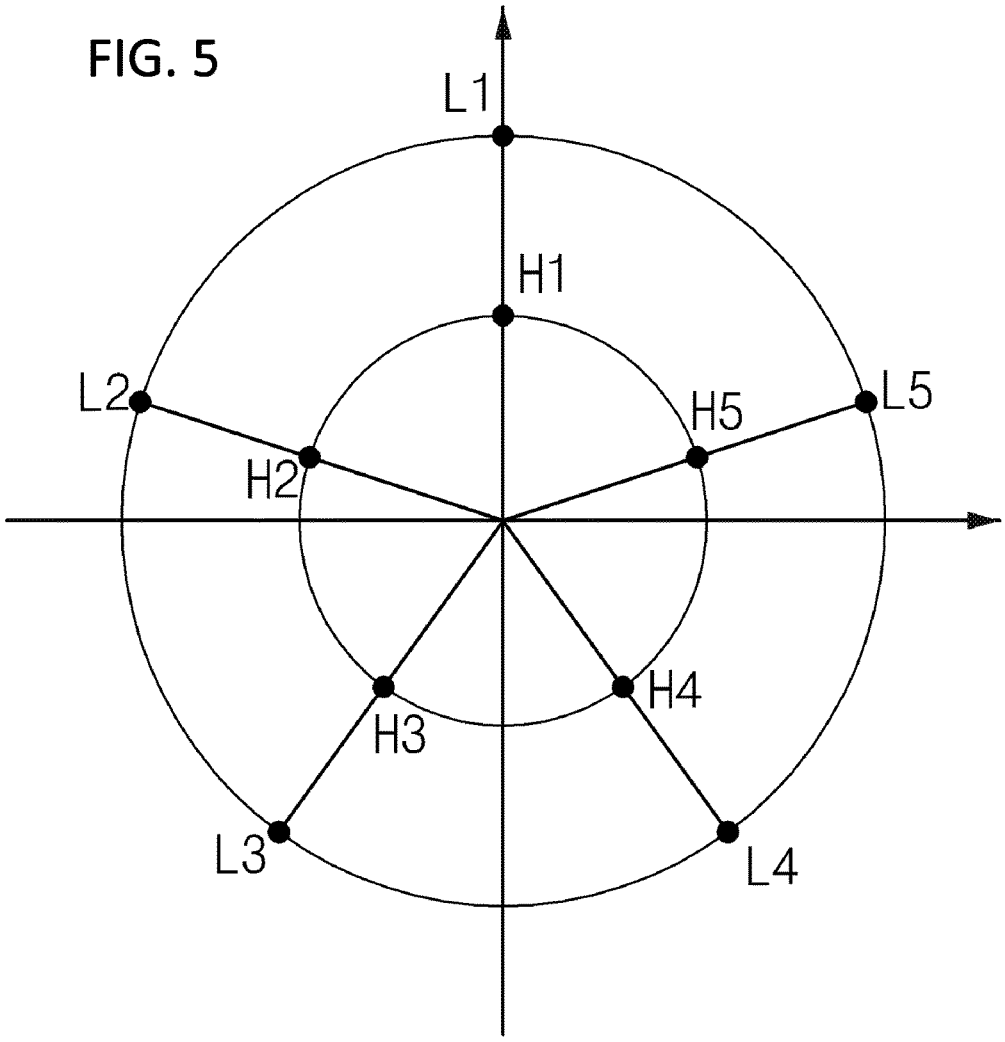
FIG. 5 is a diagram illustrating a variable antenna according to a third embodiment of the present disclosure.
Figure 6:
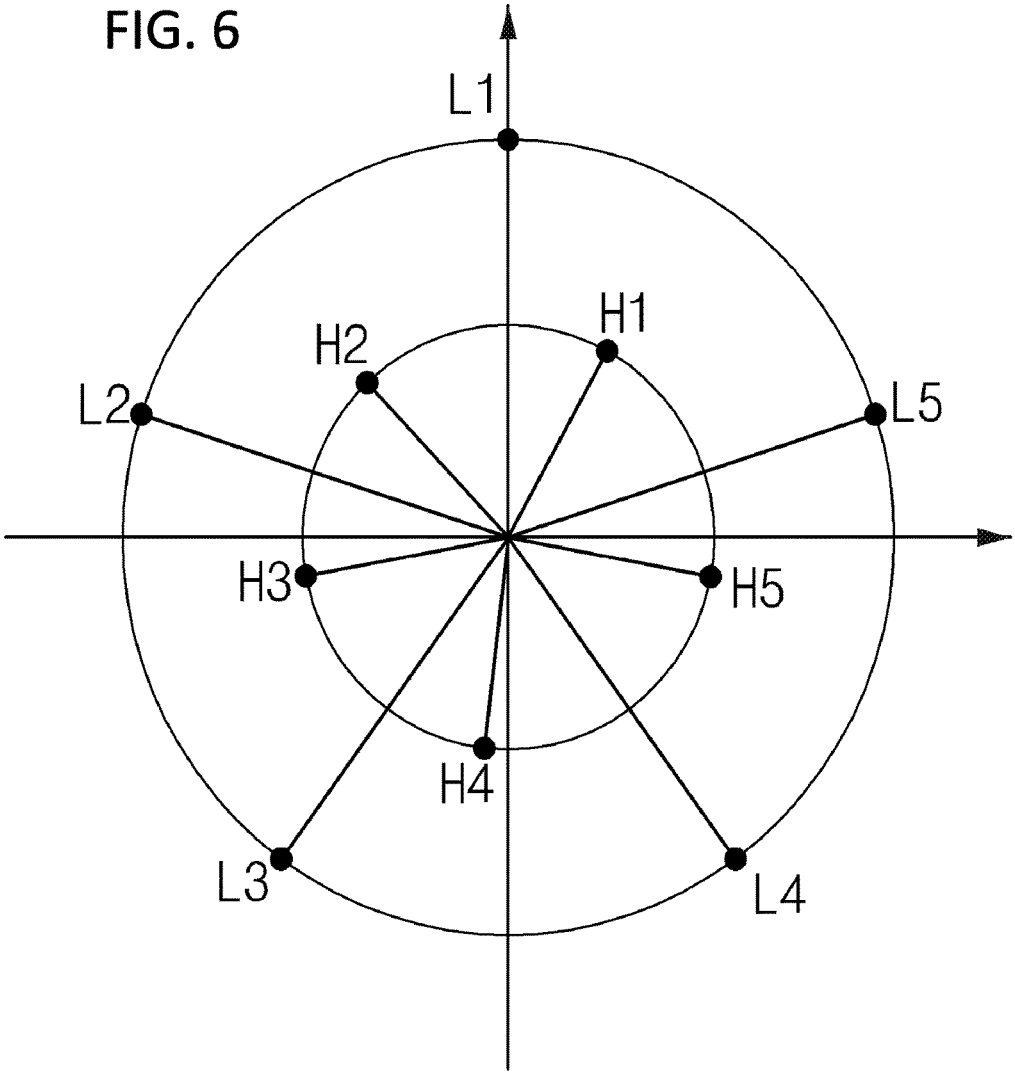
FIG. 6 is a diagram illustrating a variable antenna according to a fourth embodiment of the present disclosure.
Figure 7:
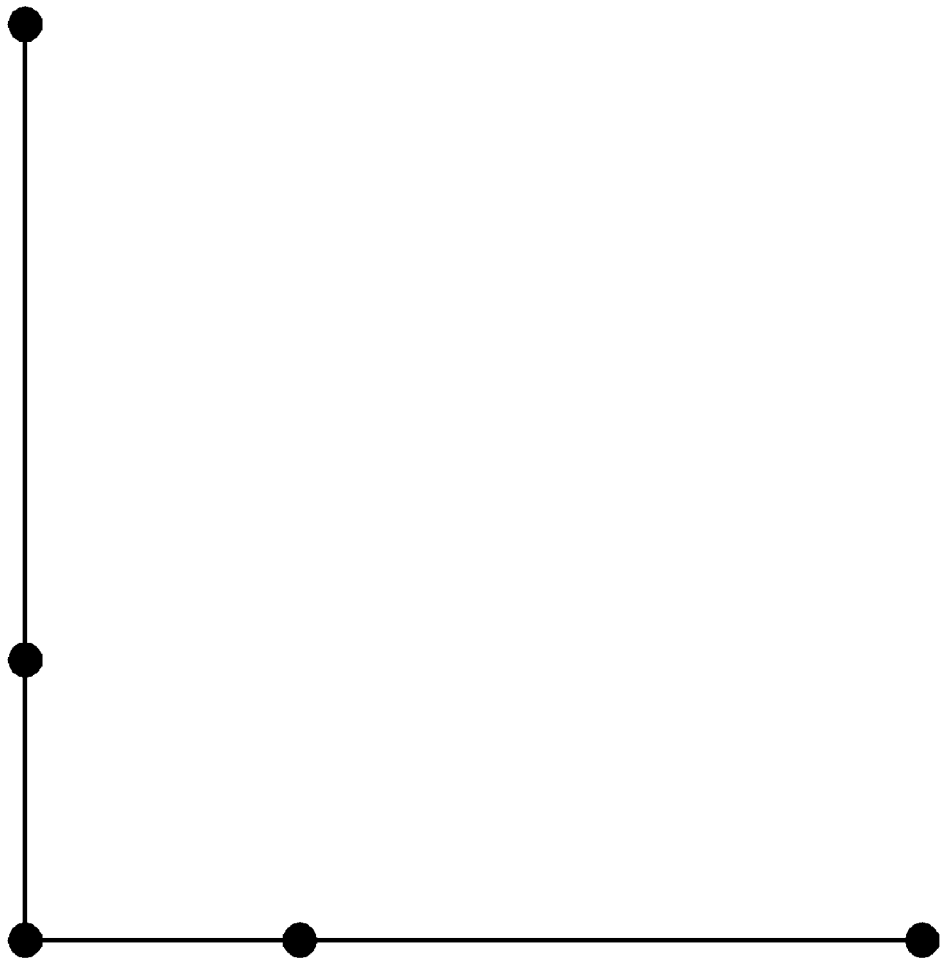
FIG. 7 is a diagram illustrating a variable antenna according to a fifth embodiment of the present disclosure.
Figure 8:
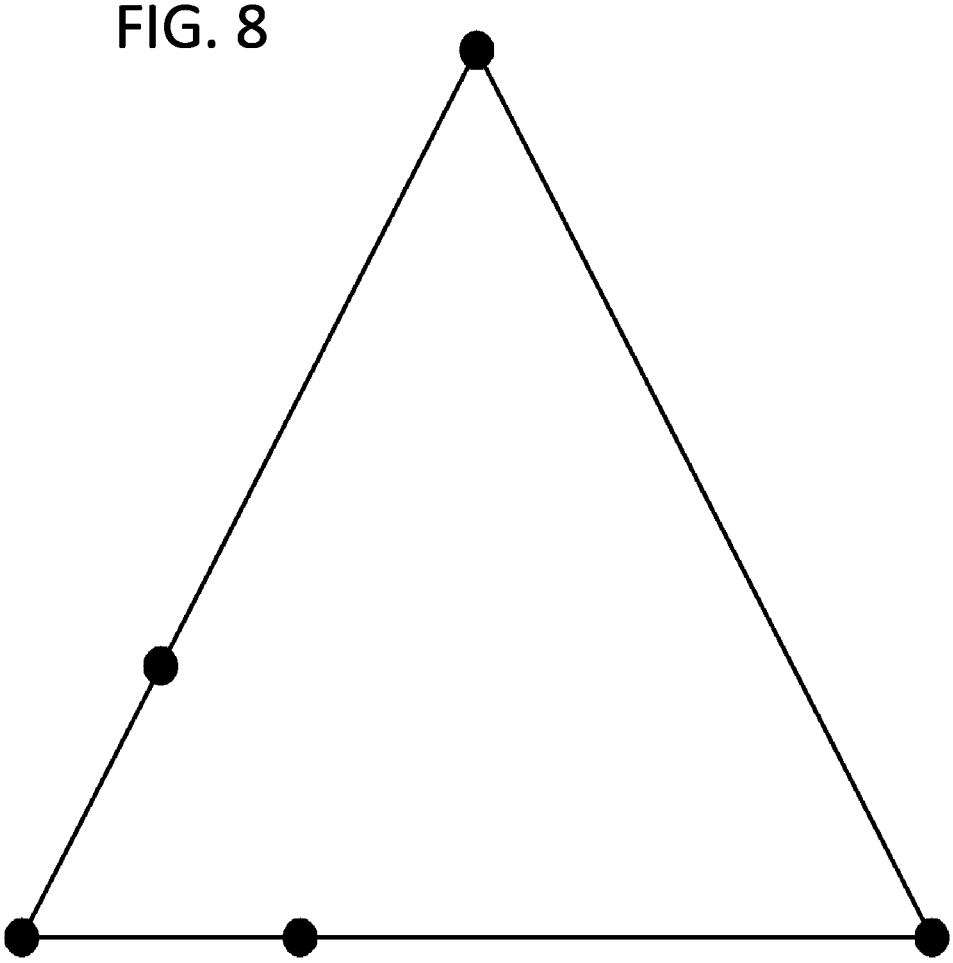
FIG. 8 is a diagram illustrating a variable antenna according to an sixth embodiment of the present disclosure.

In addition to the embodiments of FIG. 3 and FIG. 4, the antenna array may be arranged in such a manner that the antenna elements of the first receiving unit 110 and the second receiving unit 130 have a circular pattern as shown in FIG. 5 and FIG. 6. Further, as shown in FIG. 7 and FIG. 8, the antenna array may be arranged in such a manner that the antenna elements of the first receiving unit 110 and the second receiving unit 130 have a linear pattern.

Like the embodiments of FIG. 3 to FIG. 8, in homogeneous antenna elements of the variable antenna, an array having various patterns may be realized on a single bay, and the pattern is not limited to any one pattern.

However, when the variable antenna is configured by a monopole type or a loop type, a structure such as the mast for supporting the antenna element may be omitted.

The variable antenna 100 according to the present disclose configured as described above may be applied to an apparatus for detecting a radio signal to receive a radio signal to estimate the direction. The apparatus for detecting a radio signal using the variable antenna 100 is illustrated in FIG. 9.

Figure 9:
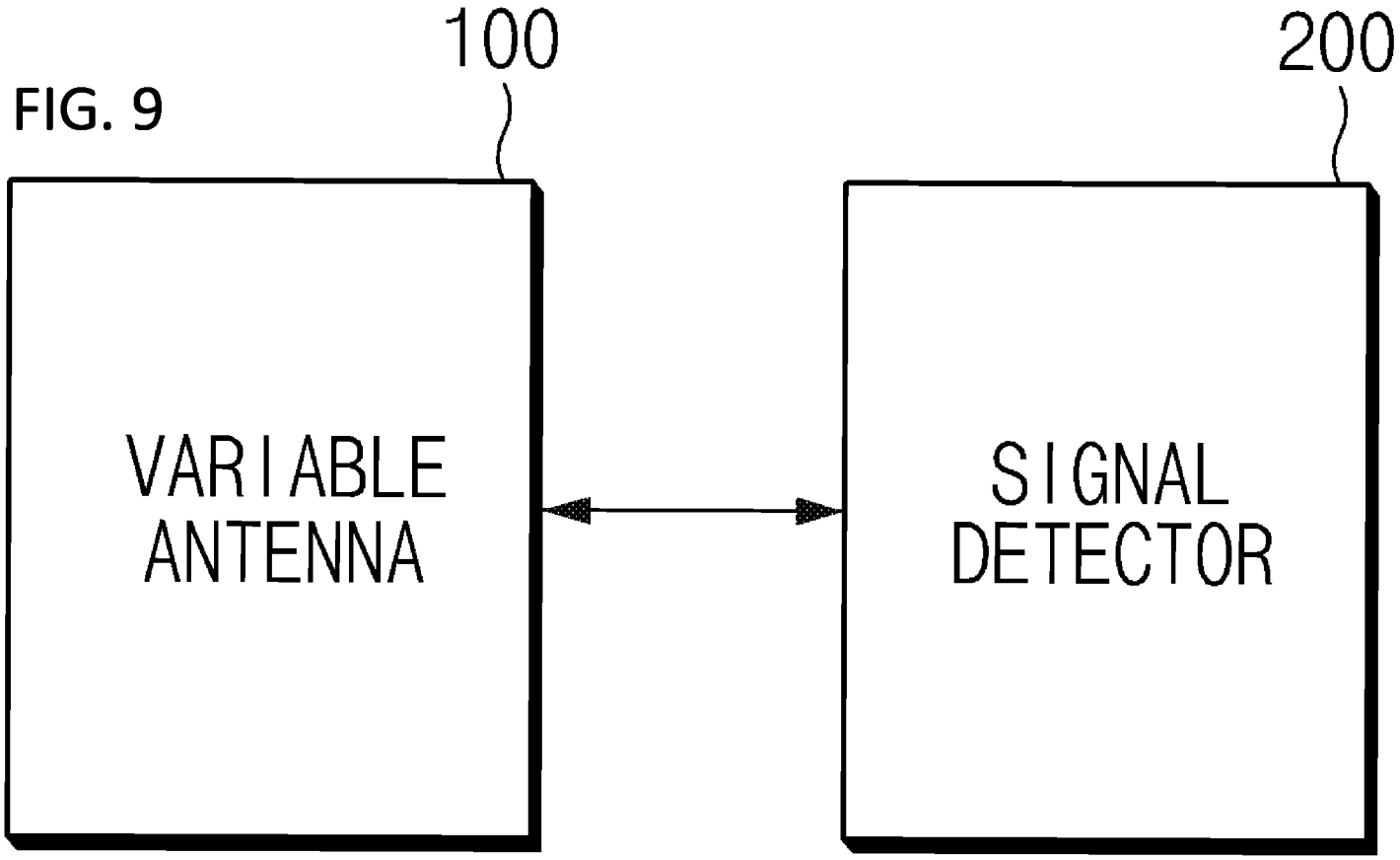
FIG. 9 is a diagram illustrating an apparatus for detecting a radio signal using a variable antenna according to the present disclosure.

FIG. 9 is a diagram illustrating an apparatus for detecting a radio signal using a variable antenna according to the present disclosure.

Referring to FIG. 9, the apparatus for detecting a radio signal may include the variable antenna 100 and a signal detector 200. Since the variable antenna 100 shown in FIG. 9 corresponds to the variable antenna 100 illustrated in FIG. 1 to FIG. 8, the repetition in the description about the same element is omitted in order to avoid redundancy.

The signal detector 200 may measure a phase of the radio signal received by the antenna elements with different lengths, and estimate the direction by using a phase difference between antennas.

In this case, the apparatus for detecting a radio signal may be realized in the form of an independent hardware element. Alternatively, the apparatus for detecting a radio signal may be at least one processor and may be included in other hardware element such as a micro-processor or a general-purpose computer system.

Accordingly, although not shown in FIG. 9, the apparatus for detecting a radio signal may include at least one processor, a memory, a user interface input element, a user interface output element, a storage, and a network interface.

The processor may be a central processing unit (CPU) or a semiconductor element for executing processing for commands stored in a memory and/or a storage. The memory and the storage may include various types of volatile or non-volatile storage medium. For example, the memory may include a Read Only Memory (ROM) and a Random Access Memory (RAM).

According to the present disclosure, heterogeneous antenna elements having a different radius of an array antenna may be arranged in a single bay by configuring an antenna using a variable liquid metal antenna, so that it is possible to secure a compact and optional antenna gain.

Further, according to the present disclosure, since a radio signal is received and the direction of the signal is detected through a variable antenna using a liquid metal antenna element, the radio signal can be measured and the direction of the signal can be estimated with a high performance in a narrow space.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A variable antenna comprising:

a first receiving unit including at least one liquid metal antenna element;

a second receiving unit including at least one liquid metal antenna element having a length different from a length of the first receiving unit; and a gain control unit which electrically adjusts lengths of the liquid metal antenna elements for one of the first receiving unit and the second receiving unit according to the frequency of a received signal, wherein an antenna array realized by the liquid metal antenna elements of the first receiving unit and an antenna array realized by the liquid metal antenna elements of the second receiving unit are arranged in a single bay.

2. The variable antenna of claim 1, wherein the gain control unit adjusts a length of the liquid metal antenna element of the first receiving unit to a minimum length when receiving the signal with a high frequency, and adjusts a length of the liquid metal antenna element of the second receiving unit to a minimum length when receiving the signal with a low frequency.

3. The variable antenna of claim 1, wherein a maximum length of the liquid metal antenna element of the first receiving unit is greater than a maximum length of the liquid metal antenna element of the second receiving unit.

4. The variable antenna of claim 1, wherein the liquid metal antenna elements of the first receiving unit and the second receiving unit are vertically arranged in different locations of the same direction based on a center axis.

5. The variable antenna of claim 1, wherein the liquid metal antenna elements of the first receiving unit and the second receiving unit are vertically arranged in different directions based on a center axis.

6. The variable antenna of claim 5, wherein the liquid metal antenna elements of the first receiving unit and the second receiving unit are alternately arranged to have a certain angle.

7. The variable antenna of claim 1, wherein a radius of the antenna array of the first receiving unit is greater than a radius of the antenna array of the second receiving unit.

8. The variable antenna of claim 1, wherein the gain control unit variably controls at least one of shapes of the liquid metal antenna elements and a radius of the antenna array according to the frequency of a received signal.

9. An apparatus for detecting a radio signal which measures the signal received by the variable antenna according to claim 1, and estimates the direction of a corresponding signal by using a phase difference between antennas.

10. An apparatus for detecting a radio signal which measures the signal received by the variable antenna according to claim 2, and estimates the direction of a corresponding signal by using a phase difference between antennas.

11. An apparatus for detecting a radio signal which measures the signal received by the variable antenna according to claim 3, and estimates the direction of a corresponding signal by using a phase difference between antennas.

12. An apparatus for detecting a radio signal which measures the signal received by the variable antenna according to claim 4, and estimates the direction of a corresponding signal by using a phase difference between antennas.

13. An apparatus for detecting a radio signal which measures the signal received by the variable antenna according to claim 5, and estimates the direction of a corresponding signal by using a phase difference between antennas.

14. An apparatus for detecting a radio signal which measures the signal received by the variable antenna according to claim 6, and estimates the direction of a corresponding signal by using a phase difference between antennas.

15. An apparatus for detecting a radio signal which measures the signal received by the variable antenna according to claim 7, and estimates the direction of a corresponding signal by using a phase difference between antennas.

16. An apparatus for detecting a radio signal which measures the signal received by the variable antenna according to claim 8, and estimates the direction of a corresponding signal by using a phase difference between antennas.

* * * * *